US005643658A

United States Patent [19]

Uchino et al.

[11] Patent Number: 5,643,658

[45] Date of Patent: Jul. 1, 1997

[54] COATED CEMENTED CARBIDE MEMBER

[75] Inventors: Katsuya Uchino; Toshio Nomura; Mitsunori Kobayashi; Masuo Chudo, all of Hyogo, Japan

[73] Assignee: Sumitomo Electric Industries, Ltd., Osaka, Japan

[21] Appl. No.: 361,030

[22] Filed: Dec. 21, 1994

Related U.S. Application Data

[63] Continuation of Ser. No. 39,976, Mar. 30, 1993, abandoned.

[30] Foreign Application Priority Data

| | | | |
|---|---|---|---|
| Apr. 17, 1992 | [JP] | Japan | 4-125541 |
| May 6, 1992 | [JP] | Japan | 4-142220 |
| Jul. 9, 1992 | [JP] | Japan | 4-182511 |

[51] Int. Cl.[6] ..... C23C 30/00

[52] U.S. Cl. ..... 428/216; 428/467; 428/472; 428/697; 428/698; 428/699; 428/701; 428/702

[58] Field of Search ..... 428/698, 212, 428/216, 697, 699, 701, 472, 469, 702

[56] References Cited

U.S. PATENT DOCUMENTS

| | | | |
|---|---|---|---|
| 3,690,962 | 9/1972 | Rudy | 29/182.7 |
| 3,909,895 | 10/1975 | Abrahamson et al. | 75/115 |
| 4,497,874 | 2/1985 | Hale | 428/698 |
| 4,610,931 | 9/1986 | Nemeth et al. | 428/547 |
| 4,698,266 | 10/1987 | Buljan et al. | 428/457 |
| 4,743,515 | 5/1988 | Fischer et al. | 428/698 |
| 4,828,612 | 5/1989 | Yohe . | |
| 5,066,553 | 11/1991 | Yoshimura et al. | 428/698 |
| 5,250,367 | 10/1993 | Santhanam et al. | 428/698 |

FOREIGN PATENT DOCUMENTS

| | | |
|---|---|---|
| 0127416 | 5/1984 | European Pat. Off. . |
| 0200991 | 11/1986 | European Pat. Off. . |
| 0337696 | 10/1989 | European Pat. Off. . |
| 0560212 | 9/1993 | European Pat. Off. . |
| 5583517 | 6/1980 | Japan . |

OTHER PUBLICATIONS

Schwarzkopf et al., "Cemented Carbides"; pp. 136 to 138.

The β-Free Layer Formed near the Surface of Vacuum-Sintered WC-β-Co Alloys Containing Nitrogen; by Suzuki et al., Transactions of the Japn Institute of Metals. vol. 22, No. 11 (1981), pp. 694 to 700.

1979, Powder and Powder Metallurgy, vol. 26, No. 6, H. Suzuki et al. Effects of a Small Amount of Addition-Carbides on High Temperature Transverse-Rupture Strength of WC-Co Cemented Carbide.

Transactions of the Japan Inst. of Metals, vol. 45, No. 1, 1981 The β-Free Layer Formed Near the Surface of Sintered WC-β-Co Alloy Containing Nitrogen, by H. Suzuki et al.

"Kinetics of Compositional Modification of (W, Ti) C-WC-Co Alloy Surfaces", * 0921-5093/88/S3.50, pp. 225-231; Elsiever Sequoia/Printed in the Netherlands; written by Schwarzkopf et al. *in Materials Science and Engineering A105/106 (1988).

*Primary Examiner*—Archene Turner
*Attorney, Agent, or Firm*—W. G. Fasse; W. F. Fasse

[57] ABSTRACT

A coated cemented carbide member includes a cemented carbide base material containing a binder metal of at least one iron family metal and a hard phase, and a coating layer provided on the surface of the cemented carbide base material. The hard phase contains at least one metal component selected from carbides, nitrides, carbo-nitrides and carbonic nitrides of Zr and/or Hf and WC. A layer consisting of only WC and an iron family metal or a binder phase enriched layer or a low hardness layer is provided on an outermost surface of each insert edge portion of the cemented carbide base material. The coating layer is a single or multiple layer consisting of at least one metal component selected from carbides, nitrides, carbo-nitrides, oxides and borides of metals belonging to the groups IVB, VB and VIB of the periodic table. Due to this structure, it is possible to improve chipping resistance with no deterioration of wear resistance in the coated cemented carbide member to be used, for example, as a cutting tool.

12 Claims, 6 Drawing Sheets

COATED CEMENTED CARBIDE MEMBER

This application is a continuation; of application Ser. No. 08/039,976, filed on Mar. 30, 1993 now abandoned.

BACKGROUND OF THE INVENTION

1. Field of the Invention

The present invention relates to a coated cemented carbide member which is applied to a cutting tool or the like and a method of manufacturing the same, and more particularly, it relates to a coated cemented carbide member which is excellent in toughness and wear resistance and to a method of manufacturing the same.

2. Description of the Background Art

A coated cemented carbide member, which comprises a cemented carbide base material and a coating layer of titanium carbide or the like vapor-deposited on its surface, is generally applied to a cutting tool of high efficiency for cutting a steel material, a casting or the like, due to toughness of the base material and wear resistance of the surface.

Cutting efficiency of such cutting tools has been improved in recent years. The cutting efficiency is determined by the product of a cutting speed (V) and an amount of feed (f). When the cutting speed V is increased, the tool life is rapidly reduced. Therefore, improvement of the cutting efficiency is attained by increasing the amount of feed f. In order to improve the cutting efficiency by increasing the amount of feed f, it is necessary to prepare a base material of the cutting tool from a tough material which can withstand high cutting stress.

In order to improve the cutting characteristics of a cutting tool by implementing inconsistent characteristics of wear resistance and chipping resistance, various proposals have been made in general. For example, there have been proposed cemented carbide base materials which are provided on outermost surfaces thereof with a layer (enriched layer) containing an iron group or family metal in a larger amount than that in the interior, a layer (β free layer) consisting of only WC and a binder metal, and a region (low hardness layer) having lower hardness as compared with the interior, in order to improve wear resistance and chipping resistance.

In an insert shown in FIG. 1, however, absolutely no β free layer is formed particularly in each cornered insert edge portion 1, while the thickness of the as-formed β free layer is extremely reduced in a peripheral portion of such a corner. Further, the insert edge portion 1 has higher hardness than the interior due to reduction of a binder phase and increase of a hard phase, and hence it is impossible to attain sufficient wear resistance and chipping resistance. When generally known chemical vapor deposition is applied as a coating method in such a coated cemented carbide, a fragile η phase is formed in the cornered insert edge portion 1 by reaction with carbon forming the base material during formation of the coating layer. Thus, chipping resistance is lowered and the coating layer fails with the η phase portion, to increase the progress of wear.

In order to improve the strength of a cemented carbide, there is a method of increasing the amount of the binder phase contained in the cemented carbide. In this case, however, plastic deformation is caused in the insert when used under high cutting speed conditions due to a high temperature applied thereto, although the toughness is improved by such increase of the amount of the binder phase.

On the other hand, there is a method of increasing the amounts of additives such as Ti and Ta in the cemented carbide to improve heat resistance, thereby improving the tool life. In this case, however, strength of the cemented carbide is extremely reduced.

SUMMARY OF THE INVENTION

An object of the present invention is to provide a coated cemented carbide member which is remarkably improved in chipping resistance with no deterioration of wear resistance.

Another object of the present invention is to provide a coated cemented carbide member having both wear resistance and toughness when used in cutting work of high efficiency.

According to a first aspect of the present invention, a coated cemented carbide member comprises a cemented carbide base material, containing a binder metal of at least one iron group or family metal and a hard phase of at least one metal component selected from carbides, nitrides, carbo-nitrides and carbonic nitrides of metals belonging to the groups IVB, VB and VIB of the periodic table, and a coating layer provided on its surface. The hard phase contains at least one element selected from carbides, nitrides, carbo-nitrides and carbonic nitrides of Zr and/or Hf, and WC. Each insert edge portion of this cemented carbide material includes an outermost surface layer consisting of only WC and an iron family metal. The coating layer provided outside the surface layer is formed by a single or multiple layer which consists of at least one material selected from carbides, nitrides, carbo-nitrides, oxides and borides of metals belonging to the groups IVB, VB and VIB of the periodic table and aluminum oxide.

According to this structure, a β free layer is also formed on the insert edge portion, whereby it is possible to improve chipping resistance of the cemented carbide member with no deterioration of wear resistance.

In a preferred embodiment of the inventive coated cemented carbide member, the layer on the surface of the base material, consisting of only WC and an iron family metal has a thickness of 5 to 50 μm in each flat portion adjoining each insert edge portion and 0.1 to 1.4 times that of the flat portion when measured directly at the corner or edge of the insert edge portion.

While the coated cemented carbide member according to the surface first aspect of the present invention has the surface layer consisting of only WC and an iron family metal on the outermost surface of each insert edge portion, a coated cemented carbide member according to a second aspect of the present invention is characterized in that each insert edge portion of a base material is provided on its outermost surface with an enriched layer of a binder phase containing a larger amount of a binder metal, or alternatively with a low hardness layer, as compared with the interior. As to the remaining structure, this coated cemented carbide member is similar to that according to the first aspect of the present invention.

Also according to this structure, it is possible to improve chipping resistance with no deterioration of wear resistance since an enriched layer or a low hardness layer are formed on a cornered portion such as an insert edge portion.

In a preferred embodiment of this coated cemented carbide member, the thickness of the enriched layer is 5 to 100 μm in a flat portion of each surface meeting to form each insert edge portion and 0.1 to 1.4 times that thickness when measured at the cornered edge of the insert edge portion. If this multiplying factor is less than 0.1 times, chipping resistance is disadvantageously deteriorated to the same degree as that of a conventional cemented carbide member having no enriched layer, although excellent wear resistance is maintained. If the multiplying factor exceeds 1.4 times, on the other hand, wear resistance is disadvantageously deteriorated although chipping resistance is remarkably improved as compared with the prior art. Further, an amount of the iron family metal contained in an enriched layer or portion of the insert edge portion immediately under the coating layer in a range of up to 2 to 50 μm in depth from the surface of the base material is preferably 1.5 to 5 times that in the interior in weight ratio. If this multiplying factor is less than 1.5 times, sufficient improvement of chipping resistance cannot be attained although excellent wear resistance is maintained. If the multiplying factor exceeds 5 times, on the other hand, wear resistance is disadvantageously deteriorated although chipping resistance is improved.

It is also possible to improve chipping resistance with no deterioration of wear resistance by forming a low hardness layer having lower hardness than the interior in the portion immediately under the coating layer in the range of up to 2 to 50 μm from the surface of the base material.

It is preferable that internal hardness of the coated cemented carbide base material is 1300 to 1700 kg/mm$^2$ in Vickers hardness (Hv) with a load of 500 g, and hardness of the low hardness layer which is formed on the insert edge portion is 0.6 to 0.95 times the internal hardness. If this multiplying factor is less than 0.6 times the internal hardness, a tendency of deterioration in wear resistance is observed. If the multiplying factor exceeds 0.95 times, on the other hand, improvement of chipping resistance is reduced.

In the coated cemented carbide member according to the first or second aspect of the present invention, it is possible to further improve wear resistance and plastic deformation resistance in the structure having a β free layer, a binder phase enriched layer or a low hardness layer on the outermost surface of the base material including each insert edge portion, when the hard phase contains at least one metal component selected from carbides, nitrides and carbonitrides of Zr and/or Hf and a solid solution of at least one metal component selected from carbides, nitrides and carbonitrides of metals belonging to the group VB of the periodic table as well as WC.

This is because a region or inner layer having higher hardness than the interior or internal core is defined in a range of up to 1 to 200 μm in depth from the surface layer, i.e., β free type layer or the binder phase enriched layer, due to employment of such a composition, thereby improving plastic deformation resistance. Such improvement of plastic deformation resistance is caused since the amount of at least one metal component selected from carbides, nitrides and carbo-nitrides of metals, having high hardness, belonging to group VB of the periodic table is increased in the inner layer over the range of up to 1 to 200 μm in depth from the surface layer of the base material as compared with the interior or internal core. Furthermore, the metal component selected from carbides, nitrides and carbo-nitrides of Zr and/or Hf is contained in the inner layer in the same weight ratio as in the interior or internal core.

Such a hard region or inner layer defined immediately under the surface layer of the base material is preferably 1 to 200 μm in thickness. No particular improvement is recognized if the thickness is less than 1 μm, while a tendency of insufficient chipping resistance is recognized if the thickness exceeds 200 μm, although effects are improved as to wear resistance and plastic deformation resistance.

The maximum hardness of such a hard region inner layer is preferably in a range of 1400 to 1900 kg/mm$^2$ in Vickers hardness (Hv) with a load of 500 g. If the maximum hardness is less than 1400 kg/mm$^2$ a tendency of insufficient wear resistance and plastic deformation resistance is recognized although the chipping resistance is improved. If the maximum hardness exceeds 1900 kg/mm$^2$, on the other hand, a tendency of insufficient chipping resistance is recognized although wear resistance and plastic deformation resistance are improved.

The coated cemented carbide according to the first or second aspect of the present invention is manufactured by the following method. First, a cemented carbide base material is sintered and thereafter each edge portion of the base material is polished to achieve bevelling to such an extent to still retain a β free layer, an enriched layer or a low hardness layer, or the cemented carbide base material is so sintered that each edge portion of the base material is previously bevelled by die pressing in the aforementioned range. The bevelling includes chamfering and curving of the edge portion. Then a coating material is applied as described below.

In order to adjust the thickness of each insert edge portion of the coated cemented carbide member while leaving a β free layer, an enriched layer or a low hardness layer on the edge portion, the invention provides a method of employing powder which is prepared by changing the total amount of at least one material selected from carbides, nitrides, carbonitrides and carbonic nitrides of Zr and/or Hf in a hard phase and holding the same in a vacuum or a constant nitrogen pressure in a temperature range of 1350° to 1500° C.

Further, it is possible to bevel each insert edge portion of the as-obtained sintered body by brushing with ceramic grains such as alumina grains or GC abrasive grains, honing by barrel polishing or grinding, thereby adjusting the ratio of the edge portion thickness of a β free layer, an enriched layer or a low hardness layer relative to that of the layer in each portion excluding the edge portion. It is also possible to form a β free layer, an enriched layer or a low hardness layer on each insert edge portion by employing powder having a composition similar to the above, previously forming the powder into a shape having a bevelled insert edge portion by die pressing and sintering the same in a similar method.

Thereafter a coating layer is formed on such a base material of cemented carbide. This coating layer is a single or multiple layer of at least one metal component selected from carbides, nitrides, carbo-nitrides, oxides and borides of metals belonging to the groups IVB, VB and VIB of the periodic table and aluminum oxide, which is formed by ordinary chemical or physical vapor deposition. Due to this coating layer, it is possible to improve wear resistance and chipping resistance in high-speed cutting in a balanced manner.

In a more preferred embodiment of the coated cemented carbide member according to the first or second aspect of the present invention, a structure having no η phase on an outermost surface of a base material in each insert edge portion is combined with a structure having a β free layer, a binder phase enriched layer or a low hardness layer on the outermost surface of the base material including such an insert edge portion. Due to this structure, it is possible to further improve wear resistance and chipping resistance. Since no fragile η phase is contained in the insert edge portion, on which a η layer is most easily precipitated in ordinary chemical vapor deposition, it is possible to prevent deterioration of insert strength caused by brittleness of the η phase thereby improving chipping resistance. It is also possible to prevent a phenomenon wherein the coating layer fails with the fragile η phase in cutting work thereby leading to progressive wear, whereby the invention improves wear resistance.

As to manufacturing such a structure containing no η phase in the insert edge portion on the outermost surface of the base material, the invention provides a method of forming a first coating layer which is in direct contact with the base material by physical vapor deposition or chemical vapor deposition employing a raw material requiring a smaller amount of carbon supply from the base material as compared with conventional chemical vapor deposition using methane as a carbon source. Considering the degree of adhesion or peeling resistance with respect to the base material, it is particularly effective to employ acetonitrile as a carbide and nitride source for forming the coating layer in a temperature range of at least 900° C. by MT-CVD (moderate temperature-chemical vapor deposition).

According to a third aspect of the present invention, a coated cemented carbide member has the below described structure in a cemented carbide containing binder metals of WC and one or more iron family metals.

The cemented carbide contains 0.3 to 15 percent by weight of a hard phase consisting of at least one metal component selected from a group of carbides, nitrides and carbo-nitrides of Zr and/or Hf and a solid solution of at least two such metal components. The cemented carbide further contains 2 to 15 percent by weight of only Co or Co and Ni as a binder phase. The cemented carbide contains tungsten carbide and unavoidable impurities in addition to the hard phase and the binder phase.

Due to such compositions of the hard phase and the binder phase, it is possible to improve wear resistance and chipping resistance of a tool in a well-balanced manner under high speed and high feed rate cutting conditions. In ordinary cutting work of a steel material or a casting, the temperature at the insert of the tool is increased to several 100° to 1000° C., leading to remarkable reduction in strength and hardness of the cemented carbide forming the tool. When a carbide of Zr or Hf and the like are added to the cemented carbide within the range of the present invention, strength of the cemented carbide is improved not only at room temperature but in a high temperature range as compared with a conventional cemented carbide containing only a carbide of Ti, Ta or Nb etc., while it is possible to maintain high hardness under a high temperature. A cemented carbide containing a carbide of Zr or Hf and the like in the range of the present invention has relatively low hardness at room temperature as compared with the prior art, while its hardness exceeds that of the prior art at a high temperature around a cutting temperature. Thus, the inventive cemented carbide is improved in hardness under a high temperature as compared with a conventional cemented carbide of the same composition containing the same amounts of a carbide and the like, whereby it is possible to maintain excellent wear resistance while improving toughness of the cemented carbide by reducing the amount of the hard phase and increasing that of the binder phase as compared with the prior art.

Further, the surface of the cemented carbide base material having such a structure is provided with the single or multiple coating layer consisting of one or more metal components selected from carbides, nitrides, oxides and borides of metals belonging to the groups IVB, VB and VIB of the periodic table and aluminum oxide.

Due to provision of such a coating layer, wear resistance is ensured on the surface of the cemented carbide. Such a coating layer can be formed by ordinary chemical or physical vapor deposition.

If the amount of the hard phase consisting of at least one metal component selected from a group of carbides, nitrides and carbo-nitrides of Zr and/or Hf and a solid solution of at least two such metal components is less than 0.3 percent by weight, it is impossible to attain a sufficient improvement in cemented carbide strength and hardness in a high temperature range and nor a sufficient of improvement in tool life in cutting in a high temperature range or at a high speed. If the amount exceeds 15 percent by weight, on the other hand, strength of the cemented carbide is extremely reduced with insufficient toughness, leading to a reduction of the tool life.

If the amount of the binder phase is less than 2 percent by weight, the tool life cannot be improved due to a reduction in the sintering property of the cemented carbide. If the amount exceeds 15 percent by weight, on the other hand, the tool life cannot be improved due to a reduction in the plastic deformation resistance.

Zr and/or Hf can be previously added to a metal in the form of a carbide in which W is dissolved, or a carbo-nitride. Also when a carbo-nitride of Zr forms a solid solution with Hf, it is possible to attain a similar effect.

It is generally known that it is possible to improve the strength of a WC-Co cemented carbide by adding Zr and/or Hf etc. thereto as discussed in "Powder and Powder Metallurgy" Vol. 26, No. 6, p. 213. As to the amount of such additive, however the subject of, study has generally been related only to a small amount of not more than 5 mol percent with respect to 10 percent of Co forming a binder phase, not more than 0.9 percent by weight in the case of ZrC and not more than 1.6 percent by weight in the case of HfC in the cemented carbide. According to the present invention, at least 5 mol percent of such additive is added with respect to a binder phase. The inventors have studied a region containing a larger amount of such additive as compared with the prior art, to find for the first time that using a cemented carbide having such composition of this region achieves an improvement of tool life.

According to a preferred embodiment of this coated cemented carbide member, a hard phase consisting of at least one metal component selected from a group of carbides, nitrides and carbo-nitrides of Zr and/or Hf and a solid solution of at least two such metal components disappears or decreases in a region immediately under the coating layer in a range of up to 2 to 100 μm in depth from the surface of the cemented carbide base material.

Toughness of the cemented carbide surface can be improved by such a structure, while toughness of the overall cemented carbide can be further improved by combination with the aforementioned composition in its interior. It is well known that a carbide of Ti etc. disappears from a cemented carbide surface by employment of a carbide or a carbo-nitride of Ti as described in Transactions of the Japan Institute of Metals, Vol. 45, No. 1, p. 90, for example. In a conventional tool of such a structure, however, the carbide and the like still remain in each insert edge portion of the tool. When a carbide or a carbo-nitride of Zr or Hf is added to the cemented carbide in the inventive coated cemented carbide member, on the other hand, the carbide or carbo-nitride disappears or decreases also in each insert edge portion. Due to this structure, it is possible to extremely improve toughness of an insert of a tool as compared with the prior art. If the layer in which a hard phase of Zr or Hf disappears or decreases is less than 2 μm in thickness from the surface of the base material, however, no effect is attained as to toughness of the surface. If the thickness exceeds 100 μm, on the other hand, wear resistance is reduced. Thus, the thickness of the layer is preferably in a range of 5 to 50 μm.

It is possible to control the thickness of the layer in which the hard phase disappears or decreases by adding a hard phase of Zr and/or Hf as a carbide, a nitride or a carbo-nitride, heating/holding the mixture in a vacuum or under a constant nitrogen pressure in a temperature range of 1350° to 1500° C. and controlling the holding time and the degree of vacuum or the nitrogen pressure.

A coated cemented carbide member according to a fourth aspect of the present invention is similar in composition to that according to the third aspect. In addition to the aforementioned or first hard phase, this coated cemented carbide member further contains 0.03 to 35 percent by weight of another or second hard phase consisting of at least one metal component selected from carbides, nitrides and carbo-nitrides of metals, excluding Zr and Hf, belonging to the groups IVB, VB and VIB of the periodic table and a solid solution of at least two such metal components.

The coated cemented carbide member of such a structure has the following characteristics.

It is possible to improve the toughness of a cemented carbide containing a carbide of Zr or Hf and the like by increasing the amount of a binder phase as compared with a conventional cemented carbide, since such a cemented carbide has high strength and hardness under a high temperature. However, this cemented carbide exhibits low hardness under a low temperature. When the cemented carbide contains only a hard phase of a carbide of Zr or Hf and the like, therefore, wear resistance may be insufficient under cutting conditions that do not cause an increase of temperature at the insert. In order to compensate for such insufficiency of wear resistance under such conditions, a carbide of metals having high hardness selected from those, excluding Zr and Hf, belonging to the groups IVB, VB and VIB of the periodic table and the like are added to the cemented carbide in addition to the carbide of Zr or Hf and the like, so that it is possible to maintain excellent hardness under a low temperature. If the amount of the carbide of metals selected from those excluding Zr and Hf, belonging to the groups IVB, VB and VIB of the periodic table is less than 0.03 percent by weight, however, no effect is attained as to improvement of hardness. If the amount exceeds 35 percent by weight, on the other hand, hardness is excessively increased to cause chipping, leading to reduction in tool life.

Other reasons for restricting the numerical values of the hard phase and a binder phase are similar to those for the aforementioned coated cemented carbide member according to the third aspect of the present invention.

Also in the coated cemented carbide member according to the fourth aspect of the present invention, the hard phase preferably disappears or decreases in a region immediately under the coating layer in a range of up to 2 to 100 μm in depth from the base material surface, similarly to the coated cemented carbide member according to the third aspect. The reason for this is identical to that described above with reference to the preferred embodiment of the coated cemented carbide member according to the third aspect of the present invention, and the thickness of such a layer is also preferably in a range of 5 to 50 μm.

In order to control this thickness, it is possible to apply a method which is similar to that described above with reference to the coated cemented carbide member according to the third aspect of the present invention.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Examples of the present invention will now be described.

EXAMPLE 1

Grade powder materials having compositions A to D of different weight percentages as shown in Table 1 were formed into tool tips each having a shape prescribed as CNMG120408 under ISO standards (see FIG. 1) The compositions A to C are according to the invention and composition D is a comparative sample. The sample tool tips were each heated to a temperature of 1450° C. in a vacuum and held at this temperature for 1 hour, and thereafter cooled. Then insert edge portions 1 of the as-obtained sintered bodies were honed with a brush employing GC abrasive grains, to be provided with curved surfaces. Thereafter the sintered bodies serving as base materials were coated with inner coating layers of a carbide, a nitride and a carbo-nitride of Ti having thicknesses of 7 μm in total and outer coating layers of aluminum oxide having thicknesses of 1 μm.

Figure 1:
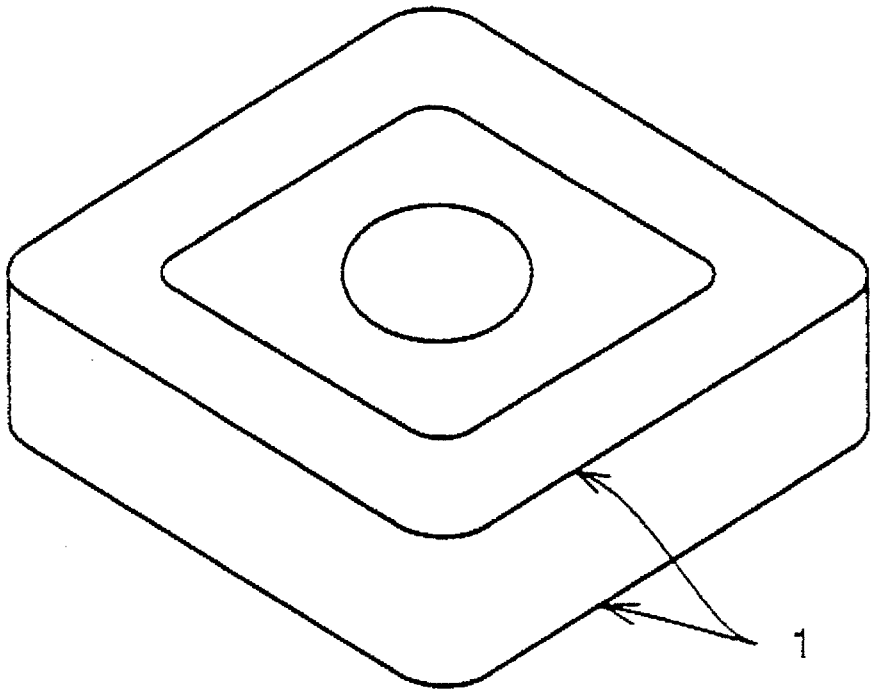
FIG. 1 PRIOR ART
FIG. 1 is a perspective view showing the shape of an insert of CNMG120408 according to ISO standards.

As to these samples, sectional structures of the insert edge portions 1 shown in FIG. 1 were analyzed to obtain the following results.

Figure 2A:
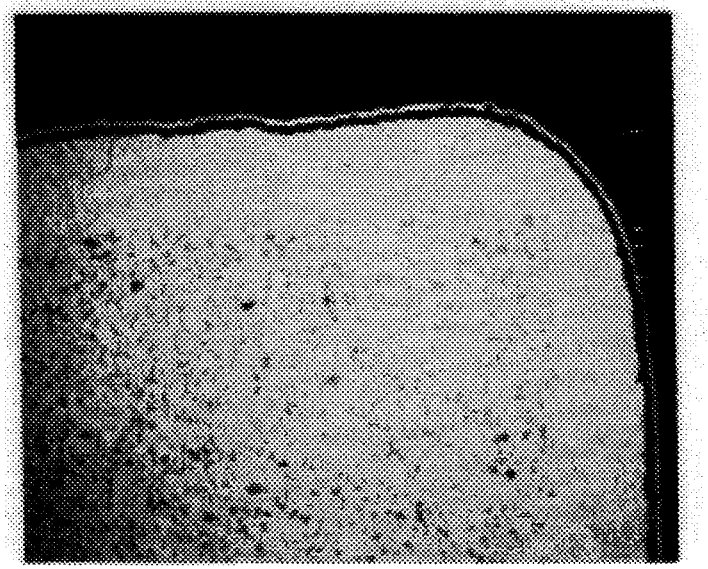
FIG. 2A is a structural photograph showing a section through an insert edge portion of a coated cemented carbide member according to Example 1 of the present invention.
Figure 2B:
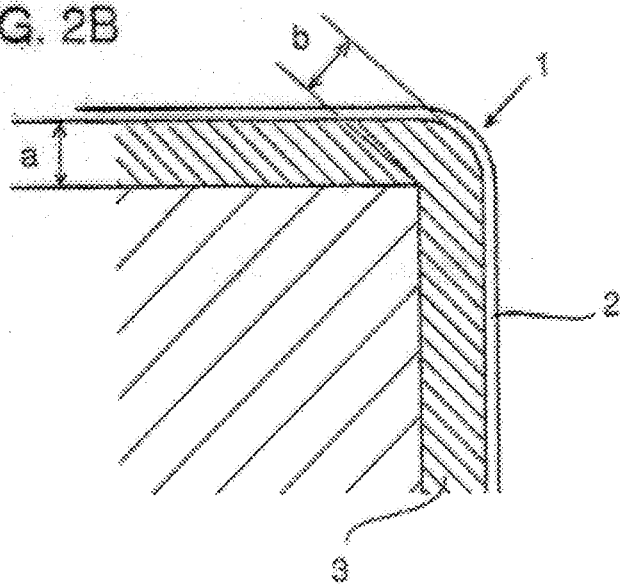
FIG. 2B is a model diagram thereof.
Figure 3A:
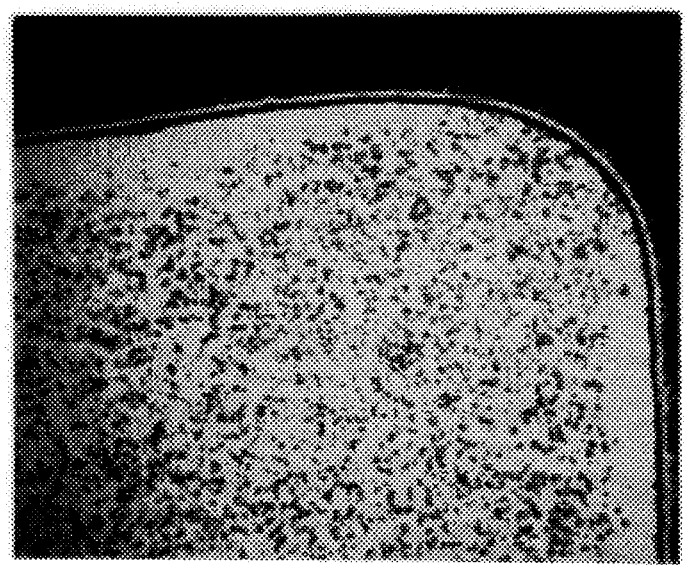
FIG. 3A PRIOR ART
FIG. 3A is a structural photograph showing a section through an insert edge portion of a conventional coated cemented carbide member.
Figure 3B:
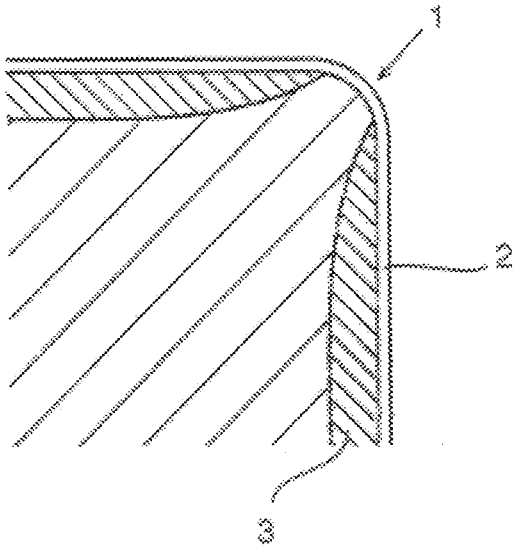
FIG. 3B PRIOR ART
FIG. 3B is a model diagram thereof.

FIGS. 2A and 2B show such a sectional structure in the sample A, while FIGS. 3A and 3B show that in the sample D. FIGS. 2A and 3A are structural photographs, and FIGS. 2B and 3B are model diagrams thereof respectively. The coating layer comprising the inner layer and the outer layer is indicated as a single layer with a reference number "2" in each of FIGS. 2B and 3B. It is understood from the model diagrams shown in FIGS. 2B and 3B that the insert edge portion 1 has a β free layer 3 extending around the edge in the sample A, while that of the sample D has no such β free layer at the edge. FIG. 2B shows the thickness a of flat surface portions of the β free layers 3, and the thickness b of the edge where two flat portions of the layers 3 meet. Table 1 also shows the thicknesses a of β free layers provided on flat portions of the respective samples, thicknesses b of those provided on insert edge portions and ratios b/a therebetween.

TABLE 1

| Sample | Composition | a: Thickness of β Free Layer on Flat Portion (μm) | b: Thickness of β Free Layer on Insert Edge Portion (μm) | Ratio b/a |
|---|---|---|---|---|
| A | WC-4% ZrN-6% Co | 40 | 25 | 0.63 |
| B | WC-8% ZrCN-4% TaC-6% Co | 30 | 20 | 0.67 |
| C | WC-4% HfN-6% Co | 40 | 25 | 0.63 |
| D | WC-2% TiCN-4% TaC-6% Co | 25 | 0 | 0 |

A to C: Inventive Samples
D: Comparative Sample

The samples A to D were subjected to evaluation of cutting performance. Cutting conditions for the evaluation tests and the results thereof are as follows:

Cutting Conditions 1 (Wear Resistance Test)
Cutting Speed: 300 m/min.
Workpiece: SCM415
Feed Rate: 0.4 mm/rev.
Cutting Time: 30 min.
Depth of Cut: 2.0 mm
Cutting Oil: water-soluble Cutting Conditions 2 (Chipping Resistance Test)
Cutting Speed: 100 m/min.
Workpiece: SCM435 (four-grooved material)
Feed Rate: 0.2 to 0.4 mm/rev.
Cutting Time: 30 sec.
Depth of Cut: 2.0 mm repeated eight times

TABLE 2

| Sample | Flank Wear under Cutting Condition 1 (mm) | Chipping Rate under Cutting Condition 2 (%) |
|---|---|---|
| A | 0.185 | 25 |
| B | 0.170 | 35 |
| C | 0.172 | 22 |
| D | 0.225 | 80 |

As clearly understood from the non-inventive comparative above test results, the sample D having no β free layer in each insert edge portion 1 was inferior to the other samples in both of flank wear and chipping rate.

EXAMPLE 2

Grade powder materials having compositions E to K of different weight percentages as shown in Table 3 were employed to form coated cemented carbide samples. Shapes of tips, sintering conditions, honing conditions for insert edge portions 1 and thicknesses of coating layers 2 were similar to those in Example 1. Table 3 also shows thicknesses, a and b respectively, of β free layers provided on flat portions and the insert edge portions in the respective samples and ratios (b/a) therebetween.

TABLE 3

| Sample | Composition | a: Thickness of β Free Layer on Flat Portion (μm) | b: Thickness of β Free Layer on Insert Edge Portion (μm) | Ratio b/a |
|---|---|---|---|---|
| E | WC-4% HfC 2% HfCN-6% Co | 5 | 0.5 | 0.1 |
| F | WC-2% ZrC-4% TiN-6% Co | 50 | 70 | 1.4 |
| G | WC-2% ZrCNO-2% HfCNO-6% Co | 5 | 1 | 0.2 |
| H | WC-2% ZrCN-4% NbC-6% Co | 4 | 0.4 | 0.1 |
| I | WC-6% ZrN-6% Co | 55 | 55 | 1.0 |
| J | WC-4% HfC-2% HfCN-6% Co | 5 | 0.4 | 0.08 |
| K | WC-2% ZrC 4% TiN-6% Co | 50 | 75 | 1.5 |

E to K: Inventive Samples

The above samples E to K were subjected to evaluation of cutting performance. Cutting conditions for the evaluation tests are as follows:

Cutting Conditions 3 (Wear Resistance Test)
Cutting Speed: 220 m/min.
Workpiece: SCM435
Feed Rate: 0.4 mm/rev.
Cutting Time: 20 min.
Depth of Cut: 2.0 mm
Cutting Oil: water-soluble Cutting Conditions 4 (Chipping Resistance Test)
Cutting Speed: 100 m/min.
Workpiece: SCM 435 (four-grooved material)
Feed Rate: 0.2 to 0.4 mm/rev.
Cutting Time: 30 sec.
Depth of Cut: 2.0 mm repeated eight times Table 4 shows the results of the evaluation tests.

TABLE 4

| Sample | Flank Wear under Cutting Conditions 3 (mm) | Chipping Rate under Cutting Conditions 4 (%) |
|---|---|---|
| E | 0.165 | 35 |
| F | 0.185 | 10 |
| G | 0.172 | 24 |
| H | 0.165 | 75 |
| I | 0.210 | 10 |
| J | 0.163 | 78 |
| K | 0.210 | 8 |
| D (Comparative Sample) | 0.235 | 80 |

As understood from the above test results, the inventive samples E to K were improved in balance between wear resistance and chipping resistance as compared with the comparative sample D having no β free layer 3 on each insert edge portion 1. The chipping rate was slightly increased in the sample H since the β free layers 3 were relatively small in thickness on both of the flat and insert edge portions. The chipping rate of the sample J was also slightly increased since the β free layer 3 provided on each insert edge portion 1 was significantly smaller in thickness than that provided on each flat portion. On the other hand, wear resistance was slightly deteriorated in the sample I since the β free layers 3 were relatively large in thickness on both of the flat and edge portions. The wear resistance of the sample K was also slightly deteriorated since the β free layer provided on each insert edge portion 1 was large in thickness. However, these inventive samples H to K were also sufficiently improved in balance between wear resistance and chipping resistance as compared with the comparative sample D.

EXAMPLE 3

Grade powder materials having compositions L and M of different weight percentages as shown in Table 5 were previously formed to have curved surfaces in insert edge portions 1 by die pressing and then sintered. Thereby sample L has a composition according to the invention, while sample M is a comparative sample. Coating layers 2 were then provided on base material surfaces of the as-formed sintered bodies, to form coated cemented carbide samples. Shapes of the tips, sintering conditions, and compositions and thicknesses of the coating layers 2 were similar to those of Examples 1 and 2. Table 5 also shows thicknesses a and b respectively, of β free layers 3 provided on flat and insert edge portions of samples L and M and ratios (b/a) therebetween.

TABLE 5

| Sample | Composition | a: Thickness of β Free Layer on Flat Portion (μm) | b: Thickness of β Free Layer on Insert Edge Portion (μm) | Ratio b/a |
|---|---|---|---|---|
| L | WC-4% HfN-2% TiC-6% Co | 30 | 40 | 1.3 |
| M | WC-4% TiN-4% TiC-6% Co | 25 | 0 | 0 |

L: Inventive Sample
M: Comparative Sample

These samples L and M were also subjected to evaluation of cutting performance. Cutting conditions for the evaluation tests were similar to the cutting conditions 3 and 4 of Example 2. Table 6 shows the results of the evaluation tests.

TABLE 6

| Sample | Flank Wear under Cutting Conditions 3 (mm) | Chipping Rate (%) |
|---|---|---|
| L | 0.175 | 20 |
| M | 0.180 | 90 |

As understood from the results of evaluation shown in Table 6, the samples L and M were approximately equivalent in wear resistance to each other. However, it was confirmed that the sample M was extremely inferior in chipping rate to the sample L. The sample M was deteriorated in chipping rate since its hard phase contained no metal component selected from carbides, nitrides, or carbo-nitrides, of Zr and/or Hf.

EXAMPLE 4

Grade powder having a composition of WC—2% ZrN—4% TiC—6% Co was employed to form a tip having the shape of CNMG120408 under ISO standards by previously chamfering each insert edge portion 1 at an angle of 25° and a dimension of 0.1 mm as measured from a rake face side by die pressing. Thereafter this tip was heated in a vacuum and held at a temperature of 1400° C. for 1 hour, to form a sintered body. Similarly to Examples 1, 2 and 3, the sintered body serving as a base material was provided with coating layers 2, to form a sample N.

Grade powder of the same composition as the above was formed into a tip having the shape of CNMG120408 under ISO standards, sintered under the same conditions as the sample N, and thereafter each insert edge portion 1 of this sintered body was ground to be chamfered similarly to the above. The sintered body serving as a base material was provided with coating layers 2 similarly to the above, to prepare a sample O.

Figure 4A:
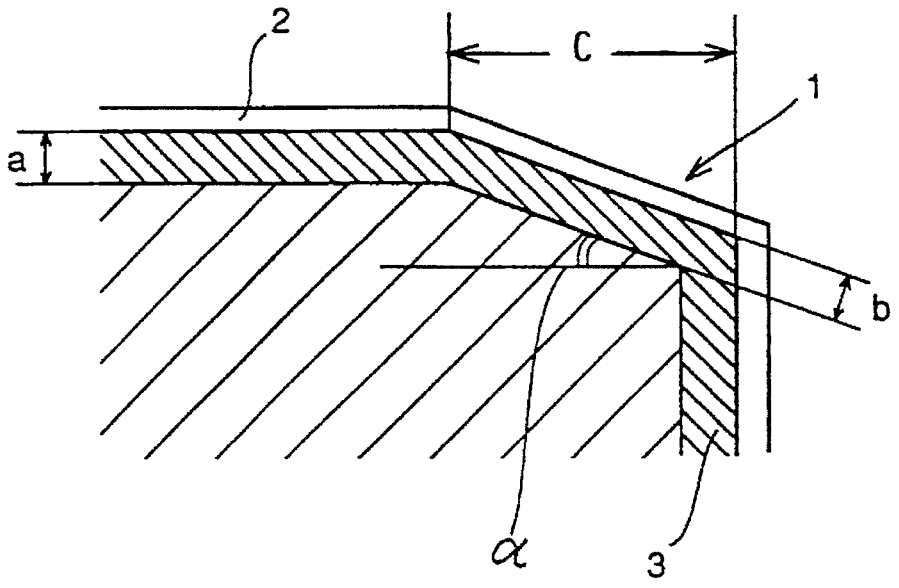
FIG. 4A is a model diagram showing a section through an insert edge portion of a coated cemented carbide member according to another Example of the present invention.
Figure 4B:
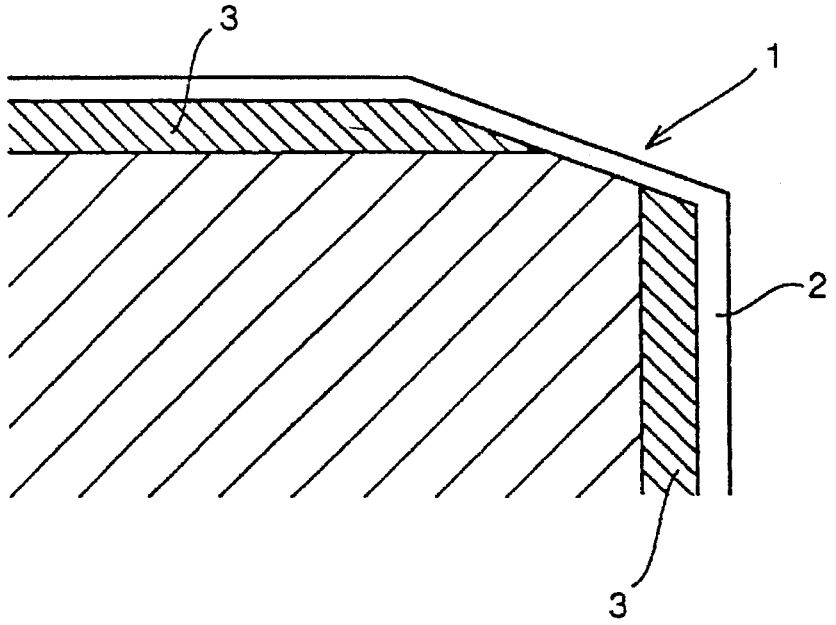
FIG. 4B PRIOR ART
FIG. 4B is a model diagram showing a section through an insert edge portion of a comparative member for that shown in FIG. 4A.

FIGS. 4A and 4B typically illustrate sections in insert edge portions 1 of the samples N and O respectively. FIG. 4A and Table 7 show thickness a of β free layers 3 provided on flat portions and thickness b of insert edge portions of the samples N and O and ratios (b/a) therebetween.

TABLE 7

| Sample | a: Thickness of β Free Layer on Flat Portion (μm) | b: Thickness of β Free Layer on Insert Edge Portion (μm) | Ratio b/a |
|---|---|---|---|
| N | 40 | 44 | 1.1 |
| O | 40 | 0 | 0 |

It is understood from FIGS. 4A and 4B that the insert edge portion 1 of the sample N according to the invention has a β free layer 3 while that of the sample O did not have such β free layer 3.

It has been proved by the results of the evaluation tests in Examples 1 to 4 that the following conditions are desirable in order to improve chipping resistance with no deterioration of wear resistance:

(1) The hard phase contains at least one metal component selected from carbides, nitrides, carbo-nitrides and carbonic nitrides of Zr and/or Hf.

(2) The β free layer has a thickness of 5 to 50 μm on each flat portion forming each insert edge portion.

(3) The β free layer provided on each insert edge portion has a thickness of 0.1 to 1.4 times that on each flat portion, i.e., a thickness of 0.5 to 70 μm.

Further Examples of the present invention will now be described.

EXAMPLE 5

Grade powder materials having different weight percentage compositions shown in Table 8 were formed into tips each having the shape of CNMG120408 under ISO standards (see FIG. 1), and thereafter these compacts were heated to 1450° C. in a vacuum and held at the temperature for 1 hour, to form sintered bodies. Then insert edge portions 1 of these sintered bodies were honed with a brush employing GC abrasive grains. Thereafter the sintered bodies serving as base materials were coated with inner coating layers of a carbide, a nitride and a carbo-nitride of Ti having thicknesses of 7 μm in total and outer coating layers of aluminum oxide to form a coating layer 2. Thus, each inventive sample had a structure generally as shown in FIG. 2B and the conventional sample had a structure generally as shown in FIG. 3B, but with an enriched layer 4' instead of a β free layer 3 shown in FIGS. 2B and 3B. Table 8 shows thicknesses a of binder phase enriched layers 4' provided on flat portions, thicknesses b of the binder phase enriched layers 4' provided on insert edge portions 1, ratios b/a therebetween and relative weight ratios of Co contained in regions immediately under the coating layers 2 in ranges of up to 2 to 50 μm in depth from the base material surfaces relative to the content in the interior or internal core of the base material. Samples A1 to C1 are inventive samples, and a sample D1 is a conventional sample.

TABLE 8

| Sample | Composition | a: Thickness of Co Enriched Layer on Flat Portion (μm) | b: Thickness of Co Enriched Layer on Insert Edge Portion (μm) | Ratio b/a | Relative Content of Co in Region of 2 to 50 μm in Depth (to Interior) |
|---|---|---|---|---|---|
| A1 | WC-8% ZrN-6% Co | 20 | 28 | 1.4 | 1.5 |
| B1 | WC-4% ZrCN-8% TaC-6% Co | 5 | 7 | 1.4 | 5.0 |
| C1 | WC-16% HfN-6% Co | 100 | 10 | 0.1 | 3.5 |
| D1 | WC-2% TiCN-4% TaC-6% Co | 20 | 0 | 0 | 1.0 |

A1 to C1: Inventive Samples
D1: Conventional Sample

The respective samples were subjected to evaluation of cutting performance under conditions similar to the cutting conditions 1 and 2 in Example 1. Table 9 shows the results of the evaluation tests.

TABLE 9

| Sample | Flank Wear under Cutting Condition 1 (mm) | Chipping Rate under Cutting Conditions 2 (%) |
|---|---|---|
| A1 | 0.170 | 45 |
| B1 | 0.172 | 30 |
| C1 | 0.180 | 22 |
| D1 | 0.225 | 80 |

As clearly understood from the above results of evaluation, it was confirmed that the samples A1 to C1 were slightly superior in wear resistance and remarkably superior in chipping resistance to the sample D1 having no binder phase enriched layer on each insert edge portion 1.

EXAMPLE 6

Grade powder materials having different weight percentages compositions shown in Table 10 were employed to form coated cemented carbide samples comprising a coating layer on a cemented carbide base material including a low hardness layer or region of the base material under the coating layer. Shapes of the tips, sintering conditions, honing conditions for insert edge portions 1, and compositions and thicknesses of coating layers 2 were similar to those in Example 1.

Table 10 also shows thicknesses of the low hardness layers provided on insert edge portions 1 of the respective samples, levels of hardness in the vicinity of the cemented carbide base material surfaces (insert edge portions 1) and the interiors thereof, and ratios therebetween.

TABLE 10

| Sample | Composition | Thickness of Low Hardness Layer on Insert Edge Portion (μm) | Hardness of Insert Edge Portion Close to Base Material Surface ($kg/mm^2$) X | Internal Hardness ($kg/mm^2$) Y | Ratio X/Y |
|---|---|---|---|---|---|
| E1 | WC-5% HfC-1% HfCN-6% Co | 2 | 1240 | 1300 | 0.95 |
| F1 | WC-3% ZrC-3% TiN-6% Co | 30 | 1350 | 1500 | 0.9 |
| G1 | WC-2% ZrCNO-2% HfCNO-6% Co | 20 | 1300 | 1550 | 0.84 |
| H1 | W-2% ZrCN-4% NbC-6% Co | 5 | 1350 | 1480 | 0.91 |
| I1 | WC-6% ZrN-4% TiC-6% Co | 50 | 1020 | 1700 | 0.60 |
| J1 | WC-4% TiC-4% HfN-6% Co | 50 | 850 | 1500 | 0.57 |
| K1 | WC-2% TaC 4% TiN-6% Co | 0 | 1350 | 1600 | 0.84 |

E1 to J1: Inventive Samples
K1: Comparative Samples

The respective samples were subjected to evaluation of cutting performance under conditions similar to the cutting conditions 3 and 4 in Example 2. Table 11 shows the results of the evaluation tests.

TABLE 11

| Sample | Flank Wear Under Cutting Conditions 3 (mm) | Chipping Rate Under Cutting Conditions 4 (%) |
|---|---|---|
| E1 | 0.182 | 35 |
| F1 | 0.180 | 40 |
| G1 | 0.176 | 30 |
| H1 | 0.176 | 43 |
| I1 | 0.165 | 10 |
| J1 | 0.215 | 3 |
| K1 | 0.172 | 85 |

As understood from the above results of evaluation, the inventive samples E1 to J1 have better balance between wear resistance and chipping resistance. The sample J1 is somewhat insufficient in wear resistance, however, from the viewpoint of the balance between wear resistance and chipping resistance, the sample J1 is better than comparative sample K1 which does not have a low hardness layer on each insert edge portion 1.

EXAMPLE 7

Figure 5A:
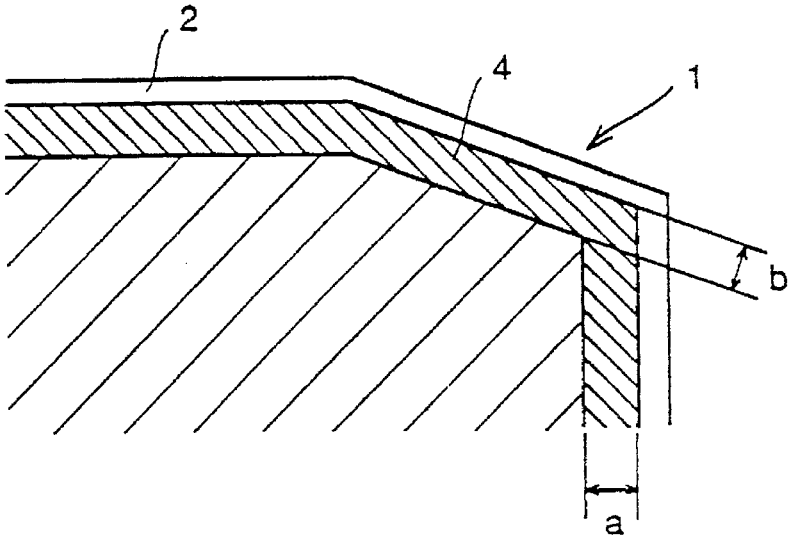
FIG. 5A is a model diagram showing a section through an insert edge portion of a coated cemented carbide member according to still another Example of the present invention.
Figure 5B:
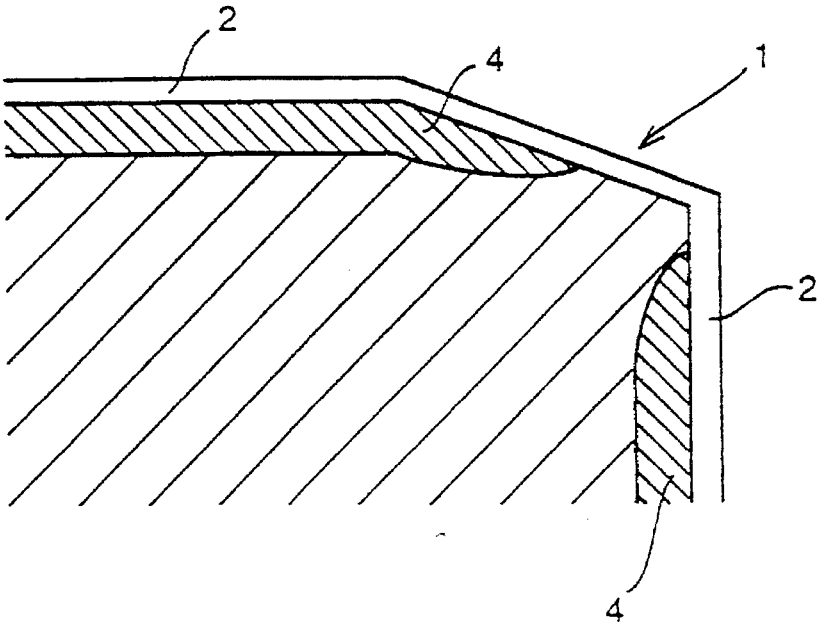
FIG. 5B PRIOR ART
FIG. 5B is a model diagram showing a section through an insert edge portion of a comparative member for that shown in FIG. 5A.

Grade powder materials having different weight percentage compositions shown in Table 12 were used to make inventive sample L1 and conventional sample M1. Sample L1 was previously formed to have chamfered insert edge portions 1 by die pressing, sintered and then provided with coating layers 2, while sample M1 was first sintered and then ground to be chamfered having binder phase enriched layers on a surface portion of the base material, under the coating layer. Shapes of the tips, sintering conditions, and compositions and thicknesses of the coating layers 2 were similar to those in Examples 5 and 6. Table 12 also shows thicknesses a of enriched layers provided on flat portions of samples L1 and M1, thicknesses b of the binder phase enriched layers provided on insert edge portions 1, ratios b/a therebetween, and relative weight ratios of Co in regions immediately under the coating layers 2 in ranges of up to 2 to 50 μm in depth from the base material surfaces relative to the base material interior. FIGS. 5A and 5B typically illustrate sections of the insert edge portions of the samples L1 and M1 respectively. The binder phase enriched layers are indicated with a reference number "4" in FIGS. 5A and 5B.

TABLE 12

| Sample | Composition | a: Thickness of Co Enriched Layer on Flat Portion (μm) | b: Thickness of Co Enriched Layer on Insert Edge Portion (μm) | Ratio b/a | Relative Content of Co in Region of 2 to 50 μm in Depth (to Interior) |
|---|---|---|---|---|---|
| L1 | WC-6% HfN-4% TiC-6% Co | 30 | 35 | 1.2 | 1.5 |
| M1 | WC-6% TiN-4% TiC-6% Co | 25 | 0 | 0 | 0.9 |

L1: Inventive Sample
M1: Conventional Sample

These samples L1 and M1 were also subjected to evaluation of cutting performance under conditions similar to the cutting conditions 3 and 4 in Example 2. Table 13 shows the results of the evaluation tests.

TABLE 13

| Sample | Flank Wear Under Cutting Conditions 3 (mm) | Chipping Rate Under Cutting Conditions 4 (%) |
|---|---|---|
| L1 | 0.175 | 20 |
| M1 | 0.178 | 75 |

It is understood from the above results of evaluation that the samples L1 and M1 were substantially equivalent in wear resistance to each other, while it was confirmed that the conventional sample M1 was extremely inferior in chipping rate to the inventive sample L1. This is because a hard phase of the sample M1 contained no metal component selected from carbides, nitrides, or carbo-nitrides of Zr and/or Hf and because sample M1 had no binder phase enriched layer at the edge portion.

It was proved from the results of the evaluation tests in Examples 5 to 7 that the following conditions are desirable in order to improve chipping resistance with no deterioration of wear resistance:

(1) The hard phase contains at least one metal component selected from carbides, nitrides, carbo-nitrides and carbonic nitrides of Zr and/or Hf.

(2) The binder phase enriched layer or the low hardness layer has a thickness of 5 to 100 μm on each flat portion forming each insert edge portion.

(3) The binder phase enriched layer or the low hardness layer provided on each insert edge portion has a thickness of 0.1 to 1.4 times the flat portion, i.e., a thickness of 0.5 to 140 μm.

(4) The amount of the iron family metal contained in the region immediately under the coating layer in a range of up to 2 to 50 μm in depth from the base material surface is 1.5 to 5 times that in the interior in weight ratio.

(5) Internal hardness of the cemented carbide is 1300 to 1700 kg/mm$^2$ in Vickers hardness with a load of 500 g, and that of the low hardness layer provided on each insert edge portion is 0.6 to 0.95 times the internal hardness.

Further Examples of the present invention will now be described.

EXAMPLE 8

Samples having compositions shown in Table 14 were formed into tips each having the shape of CNMG120408 under ISO standards, and thereafter held in a vacuum at 1450° C. for 1 hour to be sintered. Thereafter insert edge portions 1 of the sintered bodies were honed with a brush employing GC abrasive grains, to form curved or rounded edges. The as-formed sintered bodies serving as base materials were coated with inner coating layers of a carbide, a nitride and a carbo-nitride of Ti having thicknesses of 7 μm in total and outer coating layers of aluminum oxide of 1 μm in thickness.

A base material having the same composition as that of the sample A2 was coated with an inner coating layer of $TiCl_4$, $CH_3CN$ and $H_2$ having a thickness of 7 μm by MT-CVD at 950° C. and thereafter coated with an outer coating layer of aluminum oxide of 1 μm in thickness, to prepare a sample A3.

TABLE 14

| Sample | Composition |
|---|---|
| A2, A3 | WC-3 wt % ZrCN-4 wt % NbC-6 wt % Co |
| B2 | WC-3 wt. % ZrCN-4 wt % NbC-6 wt % Co |
| C2 | WC-3 wt % HfCN-2 wt % TaC-6 wt % Co |
| D2 (Conventional Sample) | WC-3 wt % TiCN-2 wt % TaC-6 wt % Co |

The aforementioned samples were analyzed to find that η phases were precipitated on insert edge portions 1 of the samples A2, B2 and C2 in thicknesses of 0.5 to 2 μm while no such η phase was precipitated on each insert edge portion 1 of the sample A3.

Each sample had a β free layer 3, a binder phase enriched layer 4' or a low hardness layer 4 of the same thicknesses. Such thicknesses were 20 μm in the samples A2 and A3, 25 μm in the sample B2 and 30 μm in the sample C2 respectively. Table 15 shows the amounts and hardness levels of metals belonging to group VB of the periodic table contained in inner layers or portions inside surface layer regions of these samples relative to the internal core of the samples.

TABLE 15

| Sample | Content of Carbo—Nitride of Group VB Metal in Portion inside Surface Layer Region (to Interior) | Content of Carbo—Nitride of Zr or Hf in Portion inside Surface Layer Region (to Interior) | Thickness of High Hardness Layer inside Surface Layer Region | Maximum Hardness of High Hardness Layer inside Surface Layer Region |
|---|---|---|---|---|
| A2 | 2.5 Times | 1.0 | 160 | 1700 |
| B2 | 1.8 Times | 1.0 | 100 | 1650 |
| C2 | 1.2 Times | 1.05 | 40 | 1550 |

The aforementioned samples, including the conventional sample D2 for comparison, were subjected to evaluation of cutting performance under the following conditions:

Cutting Conditions 5 (Wear Resistance and Plastic Deformation Resistance Tests)

Cutting Speed: 150 m/min.
Workpiece: SK5
Feed Rate: 0.7 mm/rev.
Cutting Time: 5 min.
Depth of Cut: 2.0 mm
Cutting Oil: water-soluble Cutting Conditions 6 (Chipping Resistance Test)

Cutting Speed: 100 m/min.
Workpiece: SCM435
Feed Rate: 0.2 to 0.4 mm/rev.
Cutting Time: 30 sec.
Depth of Cut: 2.0 mm repeated eight times Table 16 shows the results of the aforementioned evaluation tests.

TABLE 16

| Sample | Flank Wear (mm) | Plastic Deformation (mm) | Chipping Rate (%) |
|---|---|---|---|
| A2 | 0.14 | 0.055 | 25 |
| A3 | 0.11 | 0.054 | 18 |
| B2 | 0.16 | 0.079 | 20 |
| C2 | 0.18 | 0.090 | 10 |
| D2 | 0.28 | 0.145 | 90 |

It is understood from the above results of evaluation that the inventive samples A2, B2 and C2 were extremely superior to the comparative sample D2 not only in wear resistance and plastic deformation resistance but in chipping resistance. Further, the sample A3 was further superior to the sample A2 in wear resistance and chipping resistance. This is conceivably because each insert edge portion 1 of the sample A3 contained no η phase.

EXAMPLE 9

Raw powder materials were prepared from WC of 4 μm grain size, ZrC of 1 to 2 μm grain size, ZrN, HfC, HfN, (Zr, Hf)C (in a composition of 50 mol % ZrC), (Zr, W)C (in a composition of 90 mol % ZrC), (Hf, W)C (in a composition of 90 mol % HfC), Co and Ni respectively. These raw powder materials were wet-blended with each other to form grade powder materials having compositions shown in Table 17. The grade powder materials were press-molded into tips each having the shape of CNMG120408 under ISO standards, and thereafter heated in an $H_2$ atmosphere to a temperature of 1000° to 1450° C. at a rate of 5° C./min. The tips were then held in a vacuum at 1450° C. for 1 hour, and cooled.

TABLE 17

| No. | Wt. % ZrC | ZrN | HfC | HfN | (ZrHf)C | (ZrW)C | (HfW)C | Wt. % Co | Ni | WC | Thickness of Layer A |
|---|---|---|---|---|---|---|---|---|---|---|---|
| | | | | | | Inventive Samples | | | | | |
| 1 | 0.3 | | | | | | | 2 | | Residue | 0 |
| 2 | 2 | | | | | | | 6 | | Residue | 0 |
| 3 | 4 | | | | | | | 6 | | Residue | 5 |
| 4 | | | | | | 4.8 | | 6 | | Residue | 5 |
| 5 | | 2 | | | | | | 6 | | Residue | 15 |
| 6 | | 4 | | | | | | 6 | | Residue | 30 |
| 7 | | 8 | | | | | | 6 | | Residue | 50 |
| 8 | | | | | 10 | | | 6 | | Residue | 10 |
| 9 | 3.5 | | 6.5 | | | | | 6 | | Residue | 10 |
| 10 | | 10 | | 5 | | | | 6 | | Residue | 100 |
| 11 | | | 8 | | | | | 13 | 2 | Residue | 10 |
| 12 | | | | | | | 8.9 | 13 | 2 | Residue | 10 |
| | | | | | | Comparative Samples | | | | | |
| 13 | 0.3 | | | | | | | 1.5 | | Residue | 0 |
| 14 | | 11 | | 6 | | | | 6 | | Residue | 110 |
| 15 | | | 8 | | | | | 13 | 3 | Residue | 10 |
| 16 | WC-2 wt % Co | | | | | | | | | Residue | 0 |
| 17 | WC-2 wt % TiN-2 wt % TaC-6 wt % Co | | | | | | | | | Residue | 20 |

Then the as-formed sintered bodies serving as base materials were subjected to cutting edge processing, and coated with inner coating layers of TiC having thicknesses of 5 μm and outer coating layers of aluminum oxide having thicknesses of 1 μm, and then subjected to cutting tests under the following cutting conditions:

Cutting Conditions 7 (Wear Resistance Test)

Cutting Speed: 350 m/min.

Workpiece: SCM415

Feed Rate: 0.5 mm/rev.

Cutting Time: 20 min.

Depth of Cut: 2.0 mm

Cutting Conditions 8 (Toughness Test)

Cutting Speed: 100 m/min.

Workpiece: SCM435 (four-grooved material)

Feed Rate: 0.20 to 0.40 mm/rev.

Cutting Time: 30 sec.

Depth of Cut: 2.0 mm repeated eight times

Table 18 shows the results of the cutting tests. These samples included those having hard phase disappearance layers on base material surfaces and those having no such layers. Such hard phase disappearance layers are expressed as layers A. Thicknesses of such layers A are shown in the rightmost column of Table 17.

TABLE 18

| No. | Test 7 (Flank Wear) | Test 8 (Chipping Rate) |
|---|---|---|
| Inventive Samples | | |
| 1 | 0.20 mm | 60% |
| 2 | 0.24 | 45 |
| 3 | 0.22 | 40 |
| 4 | 0.21 | 36 |
| 5 | 0.25 | 24 |
| 6 | 0.23 | 18 |
| 7 | 0.21 | 10 |
| 8 | 0.16 | 43 |
| 9 | 0.17 | 47 |
| 10 | 0.24 | 60 |
| 11 | 0.25 | 40 |
| 12 | 0.23 | 35 |

TABLE 18-continued

| No. | Test 7 (Flank Wear) | Test 8 (Chipping Rate) |
|---|---|---|
| Comparative Samples | | |
| 13 | 0.28 | 95 |
| 14 | 0.28 | 80 |
| 15 | 0.30 | 20 |
| 16 | 0.21 | 80 |
| 17 | 0.24 | 75 |

EXAMPLE 10

Raw powder materials were prepared from WC of 4 μm grain size, ZrN of 1 to 2 μm in grain size, HfN, (Zr, Hf)C (in a composition of 50 mol % ZrC), TiC, TiN, TaC, NbC, (Ti, W)CN (in a composition of 30 wt. % TiC and 25 wt. % TiN with a remainder of WC), (Hf, W)CN (in a composition of 90 mol % HfCN with a remainder of WC), (Ti, Hf)C (in a composition of 50 mol % TIC), Co and Ni respectively to form grade powder materials having compositions shown in Table 19, similarly to Example 9. These grade powder materials were press-molded into tips each having the shape of CNMG120408 under ISO standards, and thereafter heated in an $H_2$ atmosphere to a temperature of 1000° to 1450° C. at a rate of 5° C./min. The tips were held in a vacuum at 1450° C. for 1 hour, and thereafter cooled. Then the as-formed sintered bodies serving as base materials were subjected to cutting edge processing, and coated with inner coating layers of TiC having thicknesses of 5 μm and outer coating layers of aluminum oxide having thicknesses of 1 μm by ordinary CVD, to form inventive samples 18 to 25 shown in Table 19. Samples 26 to 34 are comparative samples having compositions out of the inventive composition range.

TABLE 19

| No. | Wt. % ZrN | HfN | (ZrHf)C | TiC | TaC | NbC | TiN | (TiW)CN | Wt. % Co | Ni | WC | Thickness of Layer A (μm) |
|---|---|---|---|---|---|---|---|---|---|---|---|---|
| Inventive Samples | | | | | | | | | | | | |
| 18 | | | 0.3 | 15 | 10 | 10 | | | 2 | | Residue | 0 |
| 19 | 2 | | | 2 | | | | | 6 | | Residue | 15 |
| 20 | | 4 | | | 2 | | | | 6 | | Residue | 30 |
| 21 | 4 | | | | | | 0.03 | | 6 | | Residue | 35 |
| 22 | | 1 | | 1 | | | | | 6 | | Residue | 5 |
| 23 | 8 | | | | 2 | | | | 6 | | Residue | 50 |
| 24 | | | 15 | | | | | 5 | 6 | | Residue | 100 |
| 25 | | 4 | | | 2 | | | | 10 | 5 | Residue | 30 |
| Comparative Samples | | | | | | | | | | | | |
| 26 | | | 0.3 | 15 | 15 | 5 | | | 1.5 | | Residue | 0 |
| 27 | | | 0.3 | 26 | 10 | | | | 2 | | Residue | 0 |
| 28 | | | 16 | | | | | 4 | 6 | | Residue | 110 |
| 29 | | 4 | | | 2 | | | | 10 | 6 | Residue | 30 |
| 30 | WC-15 wt % TiCN-10 wt % TaC-10 wt % NbC-2 wt % Co | | | | | | | | 6 | | Residue | 0 |
| | WC-4 wt % TiN-2 wt % TaC-6 wt % Co | | | | | | | | 13 | 3 | Residue | 30 |

| No. | Wt. % (Zrw)CN | (HfW)CN | (TiW)CN | TiC | (T1Hf)C | TaC | Wt. % Co | Ni | WC | Thickness of Layer A |
|---|---|---|---|---|---|---|---|---|---|---|
| 26 | 2.4 | | 3.6 | | | | 6 | | Residue | 20 |
| 27 | | 4.5 | | | | 2 | 6 | | Residue | 30 |
| 28 | | | | 0.7 | 1.3 | | 6 | | Residue | 5 |

The respective samples shown in Table 19 were subjected to wear resistance and toughness tests under the following cutting conditions:

Cutting Conditions 9 (Wear Resistance Test)

Cutting Speed: 160 m/min.
Workpiece: SCM415
Feed Rate: 0.5 mm/rev.
Cutting Time: 40 min.
Depth of Cut: 1.5 mm Cutting Conditions 10 (Toughness Test)

Cutting Speed: 100 m/min.
Workpiece: SCM435 (four-grooved material)
Feed Rate: 0.15 to 0.25 mm/rev.
Cutting Time: 30 sec.
Depth of Cut: 2.0 mm repeated eight times Table 20 shows the results of the evaluation tests.

TABLE 20

| No. | Test 7 (Flank Wear) | Test 8 (Chipping Rate) |
|---|---|---|
| Inventive Samples | | |
| 18 | 0.18 mm | 60% |
| 19 | 0.20 | 35 |
| 20 | 0.21 | 25 |
| 21 | 0.22 | 28 |
| 22 | 0.24 | 48 |
| 23 | 0.20 | 22 |
| 24 | 0.24 | 14 |
| 25 | 0.24 | 35 |
| 32 | 0.20 | 32 |
| 33 | 0.20 | 22 |
| 34 | 0.23 | 42 |
| Comparative Samples | | |
| 26 | 0.30 | 95 |
| 27 | 0.17 | 74 |
| 28 | 0.28 | 45 |

TABLE 20-continued

| No. | Test 7 (Flank Wear) | Test 8 (Chipping Rate) |
|---|---|---|
| 29 | 0.28 | 33 |
| 30 | 0.24 | 90 |
| 31 | 0.28 | 88 |

EXAMPLE 11

Figure 6:
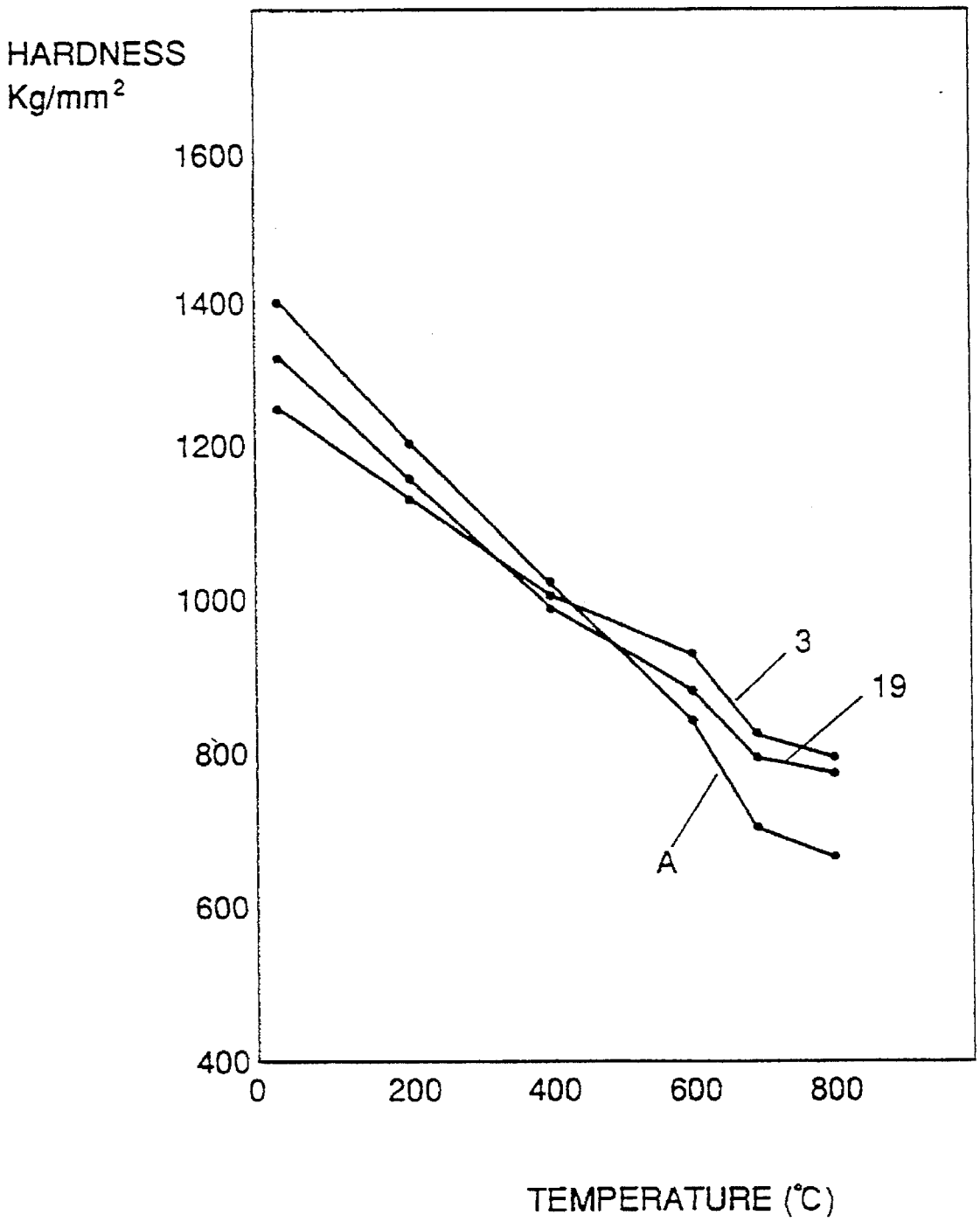
FIG. 6 is a graph showing relations between Vickers hardness levels and temperatures of two types of coated cemented carbide members according to further Examples of the present invention and a conventional coated cemented carbide member.

The samples Nos. 3 and 19 shown in Tables 17 and 19 according to Examples 9 and 10 were subjected to measurement of transverse rupture strength under the room temperature and a high temperature and measurement of high-temperature hardness. The hardness levels were measured under loads of 5 kg. Table 21 and FIG. 6 show the results, with the results of the comparative sample 17 in Table 17. It is understood from these results that the inventive samples 3 and 19 were superior to the comparative sample 17 in transverse rupture strength and hardness under high temperatures.

TABLE 21

| No. | Transverse Rupture Strength at Room Temperature | Transverse Rupture Strength at 1000° C. |
|---|---|---|
| Inventive Samples | | |
| 3 | 252 kg/mm$^2$ | 92 kg/mm$^2$ |
| 19 | 216 | 88 |
| Comparative Samples | | |
| 17 | 190 | 80 |

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A coated cemented carbide member comprising:

a cemented carbide base material having an outer surface with an edge portion and a flat surface portion; and a coating layer arranged on said outer surface;

wherein said base material consists of a binder phase consisting of at least one iron family metal, and a hard phase, wherein said hard phase consists of WC and a solid solution of at least one first metallic component selected from the group consisting of nitrides and carbo-nitrides of metals belonging to group VB of the periodic table and at least one second metallic component selected from the group consisting of nitrides and carbo-nitrides of at least one metal selected from Zr and Hf, wherein said base material comprises a surface layer consisting only of WC and an iron family metal and forming said outer surface at said flat surface portion and at said edge portion, and wherein said surface layer has a flat portion thickness of from 5 μm to 50 μm at said flat surface portion and an edge portion thickness of 0.1 to 1.4 times said flat portion thickness at said edge portion, wherein said base material further comprises an internal core and an inner layer of from 1 μm to 200 μm thickness arranged between said internal core and said surface layer, and wherein said inner layer contains the same weight proportion of said at least one second metallic component as does said internal core, and wherein said inner layer contains a greater weight proportion of said at least one first metallic component than does said internal core, and wherein said coating layer comprises at least one layer consisting of at least one metallic component selected from the group consisting of carbides, nitrides, carbo-nitrides, oxides, and borides of metals belonging to groups IVB, VB and VIB of the periodic table and aluminum oxide.

2. The coated cemented carbide member of claim 1, wherein said base material comprises from more than 2 wt. % to 15 wt. % of said hard phase which contains said at least one second metallic component, and from 2 wt. % to 15 wt. % of said binder phase which consists of Co alone or Co and Ni in combination.

3. The coated cemented carbide member of claim 1, wherein said inner layer comprises a region having higher hardness than said internal core and wherein the maximum hardness of said higher hardness region is in the range from 1400 kg/mm$^2$ to 1900 kg/mm$^2$ in Vickers hardness with a load of 500 g.

4. The coated cemented carbide member of claim 1, wherein said surface layer is disposed substantially parallel to said flat surface portion even at said edge portion.

5. A coated cemented carbide member comprising:

a cemented carbide base material having an outer surface with an edge portion and a flat surface portion; and a coating layer arranged on said outer surface;

wherein said base material consists of a binder phase consisting of at least one iron family metal, and a hard phase, wherein said hard phase consists of WC and a solid solution of at least one first metallic component selected from the group consisting of nitrides and carbo-nitrides of metals belonging to group VB of the periodic table and at least one second metallic component selected from the group consisting of nitrides and carbo-nitrides of at least one metal selected from Zr and Hf, wherein said base material comprises an internal core and a surface layer that contains a larger proportion of said binder phase than does said internal core and that forms said outer surface at said flat surface portion and at said edge portion, and wherein said surface layer has a flat portion thickness of from 5 μm to 50 μm at said flat surface portion and an edge portion thickness of 0.1 to 1.4 times said flat portion thickness at said edge portion, wherein said base material further comprises an inner layer of from 1 μm to 200 μm thickness arranged between said internal core and said surface layer, and wherein said inner layer contains the same weight proportion of said at least one second metallic component as does said internal core, and wherein said inner layer contains a greater weight proportion of said at least one first metallic component than does said internal core, and wherein said coating layer comprises at least one layer consisting of at least one metallic component selected from the group consisting of carbides, nitrides, carbo-nitrides, oxides, and borides of metals belonging to groups IVB, VB and VIB of the periodic table and aluminum oxide.

6. The coated cemented carbide member of claim 5, wherein said base material comprises from more than 2 wt. % to 15 wt. % of said hard phase which contains said at least one second metallic component, and from 2 wt. % to 15 wt. % of said binder phase which consists of Co alone or Co and Ni in combination.

7. The coated cemented carbide member of claim 5, wherein said inner layer comprises a region having higher hardness than said internal core and wherein the maximum hardness of said higher hardness region is in the range from 1400 kg/mm$^2$ to 1900 kg/mm$^2$ in Vickers hardness with a load of 500 g.

8. The coated cemented carbide member of claim 5, wherein said surface layer is disposed substantially parallel to said flat surface portion even at said edge portion.

9. A coated cemented carbide member comprising:

a cemented carbide base material having an outer surface with an edge portion and a flat surface portion; and a coating layer arranged on said outer surface;

wherein said base material consists of a binder phase consisting of at least one iron family metal, and a hard phase, wherein said hard phase consists of WC and a solid solution of at least one first metallic component selected from the group consisting of nitrides and carbo-nitrides of metals belonging to group VB of the periodic table and at least one second metallic component selected from the group consisting of nitrides and carbo-nitrides of at least one metal selected from Zr and Hf, wherein said base material comprises an internal core and a surface layer having a lower hardness than said internal core and forming said outer surface at said flat surface portion and at said edge portion, and wherein said surface layer has a flat portion thickness of from 5 μm to 50 μm at said flat surface portion and an edge portion thickness of 0.1 to 1.4 times said flat portion thickness at said edge portion, wherein said base material further comprises an inner layer of from 1 μm to 200 μm thickness arranged between said internal core and said surface layer, and wherein said inner layer contains the same weight proportion of said at least one second metallic component as does said internal core, and wherein said inner layer contains a greater weight proportion of said at least one first metallic component than does said internal core, and wherein said coating layer comprises at least one layer consisting of at least one metallic component selected from the group consisting of carbides, nitrides, carbonitrides, oxides, and borides of metals belonging to groups IVB, VB and VIB of the periodic table and aluminum oxide.

10. The coated cemented carbide member of claim 9, wherein said base material comprises from more than 2 wt. % to 15 wt. % of said hard phase which contains said at least one second metallic component, and from 2 wt. % to 15 wt. % of said binder phase which consists of Co alone or Co and Ni in combination.

11. The coated cemented carbide member of claim 9, wherein said inner layer comprises a region having higher hardness than said internal core and wherein the maximum hardness of said higher hardness region is in the range from 1400 $kg/mm^2$ to 1900 $kg/mm^2$ in Vickers hardness with a load of 500 g.

12. The coated cemented carbide member of claim 9, wherein said surface layer is disposed substantially parallel to said flat surface portion even at said edge portion.

* * * * *

UNITED STATES PATENT AND TRADEMARK OFFICE

CERTIFICATE OF CORRECTION

PATENT NO. : 5,643,658

DATED : Jul. 1, 1997

INVENTOR(S) : Uchino et al.

It is certified that error appears in the above-indentified patent and that said Letters Patent is hereby corrected as shown below:

Col. 2, line 37, after "metal" insert --,--;
line 42, delete "surface".

Col. 11, line 21, after "thicknesses" insert --,--.

Col. 12, line 17, after "therebetween." insert:

--As also shown in Fig. 4A, the chamfered insert edge portion has a lateral width C of 0.1 mm, and a chamfer angle $\alpha$ of 25°.--.

Col. 16, line 28, after "times" insert --the thickness of--.

Col. 20, following Example 10, line 7, replace "TIC" by --TiC--.

Col. 21, Table 20, col. 2, replace the heading to read: --Test 9--;
col. 3, replace the heading to read: --Test 10--.

Signed and Sealed this

Twenty-fifth Day of November, 1997

*Attest:*

Bruce Lehman

BRUCE LEHMAN

*Attesting Officer*

*Commissioner of Patents and Trademarks*